United States Patent [19]

Shirak

[11] 4,118,174

[45] Oct. 3, 1978

[54] WICK LIGHTER WITH WAX HOLDER

[76] Inventor: Michael Shirak, 5480 Springwells, Detroit, Mich. 48210

[21] Appl. No.: 773,207

[22] Filed: Mar. 1, 1977

[51] Int. Cl.[2] ..... F23D 13/16

[52] U.S. Cl. ..... 431/289; 431/327; 431/298; 126/25 B

[58] Field of Search ..... 431/325, 298, 299, 267, 431/289, 301, 315, 327, 290; 126/25 B; 110/1 L

[56] References Cited

U.S. PATENT DOCUMENTS

| | | | |
|---|---|---|---|
| 2,189,412 | 2/1940 | Arnone | 431/325 |
| 2,406,518 | 8/1946 | Urbank | 431/289 |
| 2,574,968 | 11/1951 | Harriman et al. | 431/968 |

*Primary Examiner*—Carroll B. Dority, Jr.

*Attorney, Agent, or Firm*—Harness, Dickey & Pierce

[57] ABSTRACT

A lighter for a candle and the like is provided with a coil at one end with the turns of increasing diameter near the center to form a chamber for wax which flows thereinto when heated by said coil. A wick is secured within the coil and is lit at the extending end to heat the turns thereof so that it can be inserted into the wax in a container which will immediately melt and flow into the chamber to supply the wax to the flame when the wick is lit.

8 Claims, 7 Drawing Figures

WICK LIGHTER WITH WAX HOLDER

BACKGROUND OF THE INVENTION

Short hand-held lighters as well as those on long handles have been known in the art but these usually embody tubes for tapers which flare up and splash wax over the surrounding area which is difficult to clean. In the present arrangement, the wick of the lighter is supplied with the wax in a small surrounding chamber in which the wick is supported and which may be lit to light candles or other elements, with the wax supply effective for as much as 200 different lightings. To renew the effectiveness of the lighter, the coiled end may be heated and placed within the wax in a container so it can be melted to flow within the coil chamber the end turns of which support the wick. This arrangement is believed to be new and a substantial advantage over the use of tapers in slotted tubes which may be moved into or out of the end thereof.

SUMMARY OF THE INVENTION

The lighter is made from a spring-like wire which is reversely bent at one end to form a handhold and formed as a coil spring on the opposite end for supporting a length of wick and a quantity of wax. The coil has five or six turns, each turn increasing in diameter from the ends toward the center with the turns in abutting relation for forming a chamber within the coil about the wick material. In a second form the wire at the end of the coil may extend toward the handle portion and then be offset laterally and provided with a straight coil from which a continued length of wire forms a handle. This permits a wick of substantial length, such as a length of a pipe cleaner, to extend into the top chambered wax coil and through the intermediate coil and be retained against the wire of the handle portion by a small ring which may be slid along the wick and handle portion. In some instances, the handle portion may be extended by employing a substantial length of wood handle so that the lighter may be used for candles on an alter or other places which require the use of a lighter of substantial length so that the tall or remote candles may be lit thereby. The wax chamber around the wick will become hot when the lighter is lit and can be pushed into the wax of a small container which will melt and flow into the interior of the coil about the wick the same as the melted wax of a candle. The coil forms the chamber for the wax which will be heated as the coil is warmed up by the flame to feed the wick.

DESCRIPTION OF THE PREFERRED EMBODIMENTS

Figure 1:
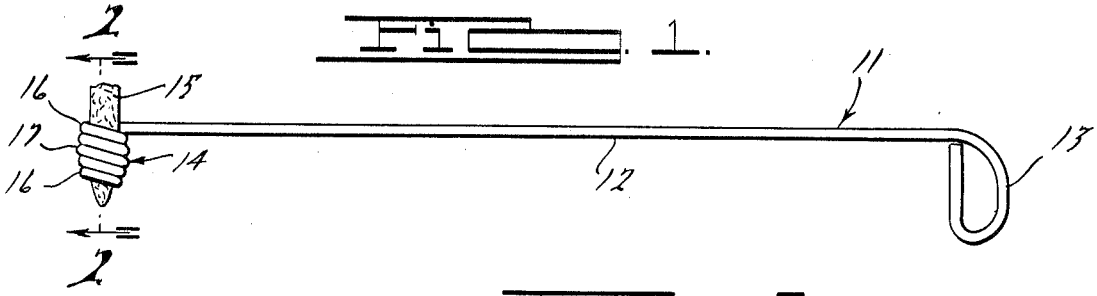
FIG. 1 is a view of a simple lighter having a coiled end for supporting the wax about a wick which embodies features of the present invention.
Figure 2:
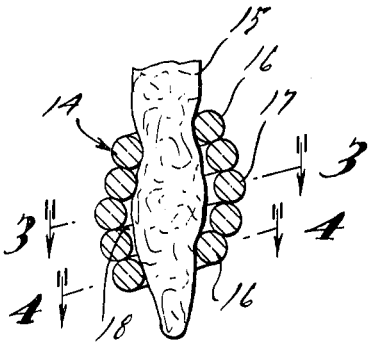
FIG. 2 is an enlarged sectional view of the structure illustrated in FIG. 1, taken on the line 2—2 thereof.
Figure 3:
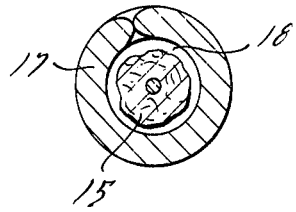
FIG. 3 is a sectional view of the structure illustrated in FIG. 2, taken on the line 3—3 thereof.
Figure 4:
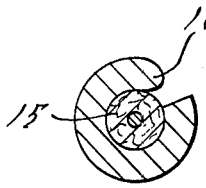
FIG. 4 is a sectional view of the structure illustrated in FIG. 2, taken on the line 4—4 thereof.

The lighter 11 of FIG. 1 is made from a wire having a holder portion 12, herein illustrated as being approximately six inches long, with a reversely bent portion 13 which is held in the hand. A coil 14 is formed on the opposite end of the wire which supports a piece of wick material 15. The wire is hard and is readily coiled but not too easily bent so that it retains the form illustrated in the Figures. The coil 14 has the end turns 16 of smaller diameter than the central turns 17 as is apparent in the enlarged view of FIG. 2. The turns 16 of smaller diameter engage and secure the length of wick 15 while the central portion of the coil 14 has a wax chamber 18 formed therein in which the wax may be stored and used when the wick is lit.

Figure 7:
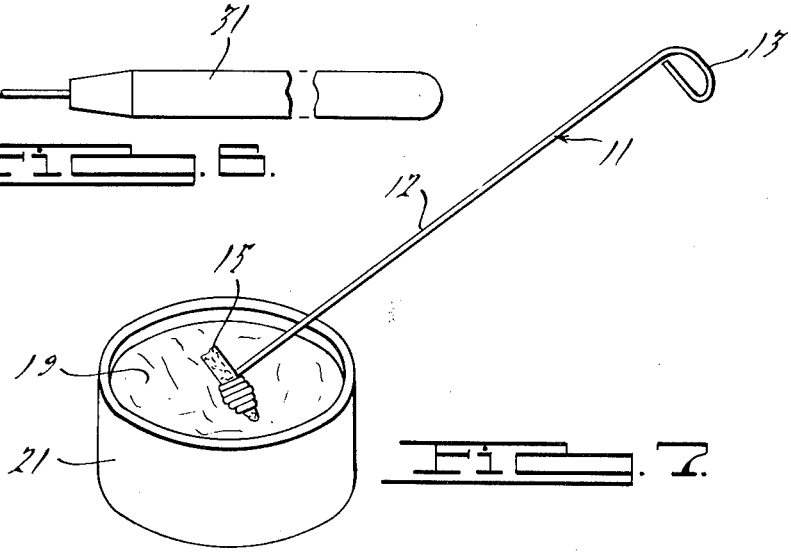
FIG. 7 is a perspective view of the lighter illustrated in FIG. 1, when heated and disposed within wax in a container.

After the lighter 11 has the end of the wick 15 lit, the lack of a supply of wax in the chamber 18 may be noted and after burning for a short time to heat the turns 16 and 17, the coil 14 is pushed into a wax 19 in a container 21, as illustrated in FIG. 7. This will melt the wax and probably extinguish the flame but will let the wax flow between the turns 16 and 17 and fill the chamber 18 about the wick. As a result, a supply of the wax will be available within the chamber for quite some time, as pointed out hereinabove.

Figure 5:
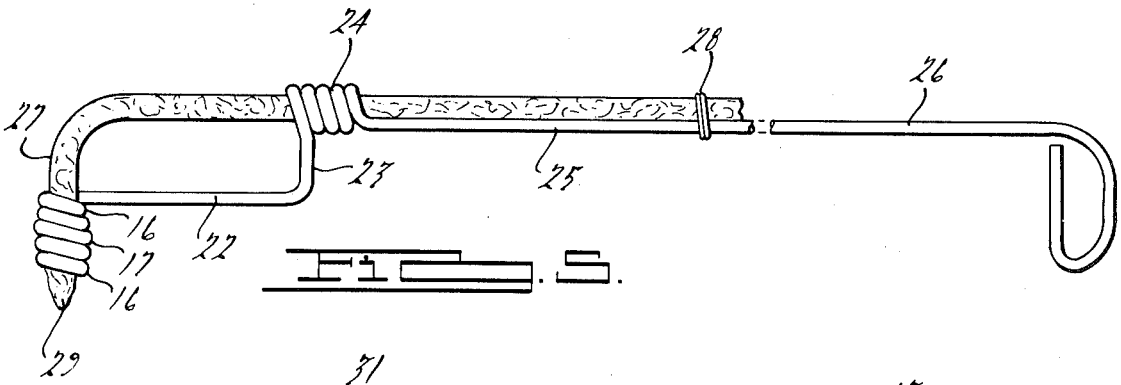
FIG. 5 is a view of structure, similar to that illustrated in FIG. 1, showing a further form of the invention.

A further form of the invention is illustrated in FIG. 5 wherein the turns 16 and 17 have the wire therefrom extended at 22 and laterally at 23 and formed into a straight coil 24 and continued therefrom at 25 to form a handle portion 26. In this arrangement, a length of wick 27 has an end portion passed through the turns 16 and 17 with one end extending forwardly and the other end reversely bent and passed through the straight coil 24 and along the handle portion 25 and 26 against which the wick is supported by a wire ring 28. The wick 27 is preferably a length of a pipe cleaner which is the proper size for the flame which will burn when the end 29 of the wick extending from the coil is lit. The front end 29 of the wick will support the flame which will not pass beyond the turns 16 and 17 to bother the unwaxed reversely bent portion of the wick. Since the flame produced by the end of the wick and the coil is always the same when supplied with the wax in the chamber 18, it is more reliable than the lighters which employed adjustable lengths of tapers.

Figure 6:
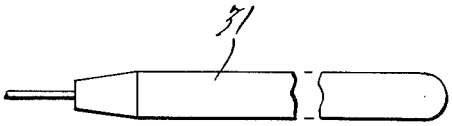
FIG. 6 is a view of a broken handle portion for a light which may be employed with the lighter of FIG. 5 to provide a substantial length thereto.

Applicant has illustrated in FIG. 6 a wood handle 31 which may be of substantial length to permit one to reach up and light a high candle on an altar or located in a spot which requires substantial reaching to produce a light. So long as the wax is provided within the coil about the wick, a standard flame will always be maintained which will be harmless to the surrounding area. Such areas may receive the splash from a taper in a holder when extended a substantial distance from its end. The flame of the extended end can flare up and melt the wax and distribute it over parts which will require substantial effort to remove.

What is claimed:

1. In a lighter for igniting a candle and the like, a wire formed into a handle at one end, a coil wound from turns of said wire at the other end, said coil projecting at right angles to said wire, a wick supported in said coil, and wherein the central turns of said coils are of greater diameter than the end turns which engage and support the wick.

2. In a lighter as recited in claim 1, wherein the central turns of greater diameter form a chamber for supporting a wax.

3. In a lighter as recited in claim 1, wherein the end of the wick which extends from the end of said coil supports the flame when the lighter is lit.

4. In a lighter as recited in claim 3, wherein a long wood handle is attached to the extending end of the wire to permit the flame thereof to be applied to candles of substantial height and remote location.

5. In a lighter as recited in claim 4, wherein the wick is of substantial length and is supported against the wire portion which extends from the coil by a small metal ring.

6. In a lighter as recited in claim 5, wherein the wire extends downwardly from the coil which supports the wick, bent laterally, formed into a straight coil and extended therefrom to form a handle portion with a length of wick extending through the straight coil adjacent to the handle portion and bent and extended through the coil having turns of different diameters.

7. In a lighter as recited in claim 1, wherein the turns of the coil become heated when the wick is lit to cause the wax in the chamber to melt and feed the flame.

8. In a lighter as recited in claim 7, wherein the coil will be heated when the chamber needs wax, and a wax within a container which will melt when the coil is placed therein and flow into the chamber from between said turns.

* * * * *

UNITED STATES PATENT AND TRADEMARK OFFICE

CERTIFICATE OF CORRECTION

PATENT NO. : 4,118,174

DATED : October 3, 1978

INVENTOR(S) : Michael Shirak

It is certified that error appears in the above–identified patent and that said Letters Patent are hereby corrected as shown below:

Column 3, line 6 (Claim 3), "1" should be --2--.
Column 4, line 8 (Claim 7), "1" should be --2--.

Signed and Sealed this

*Sixth* Day of *March 1979*

[SEAL]

*Attest:*

RUTH C. MASON
*Attesting Officer*

DONALD W. BANNER
*Commissioner of Patents and Trademarks*